US006481032B2

(12) United States Patent
Milano et al.

(10) Patent No.: US 6,481,032 B2
(45) Date of Patent: Nov. 19, 2002

(54) INFANT PROP

(76) Inventors: Frank M. Milano, P.O. Box 579, Burleson, TX (US) 76097; Trona K. Williamson, P.O. Box 759, Burleson, TX (US) 76097; Ignacio S. Perez, 832 Colony Dr., Crowley, TX (US) 76036

( * ) Notice: Subject to any disclaimer, the term of this patent is extended or adjusted under 35 U.S.C. 154(b) by 0 days.

(21) Appl. No.: 09/912,200

(22) Filed: Jul. 24, 2001

(65) Prior Publication Data

US 2002/0020021 A1 Feb. 21, 2002

Related U.S. Application Data

(60) Provisional application No. 60/220,333, filed on Jul. 24, 2000.

(51) Int. Cl.[7] ..... A47G 9/00; A47D 15/00
(52) U.S. Cl. ..... 5/655; 5/632; 5/911
(58) Field of Search ..... 5/655, 490, 632, 5/911

(56) References Cited

U.S. PATENT DOCUMENTS 5,056,533 A * 10/1991 Solano ..... 128/876
5,371,909 A * 12/1994 McCarty ..... 5/490
5,375,278 A * 12/1994 VanWinkle et al. ..... 5/490
5,392,785 A * 2/1995 Donahue ..... 128/873
5,546,620 A * 8/1996 Matthews ..... 5/639
6,058,848 A * 5/2000 Futami et al. ..... 104/71
6,088,854 A * 7/2000 Brownrigg ..... 5/632
6,161,239 A * 12/2000 Grazel ..... 5/655
6,253,400 B1 * 7/2001 Rudt-Sturzenegger et al. . 5/630

FOREIGN PATENT DOCUMENTS

WO WO 094009689 * 5/1994 ..... 5/655

* cited by examiner

*Primary Examiner*—Michael F. Trettel
(74) *Attorney, Agent, or Firm*—Guy V. Manning

(57) ABSTRACT

An infant prop comprises a cylindrical core covered with a flannel sheath. The core is approximately two inches in diameter and sufficiently long to form a U-shaped arch reaching around a sleeping infant. It comprises a flexible shell filled with plastic prills or other beads sufficient to maintain its shape but with enough space inside to allow folding and flexibility. The flannel sheath includes an opening for inserting the shell at one end and attachment means for a pacifier disposed facing the infant's mouth, while the other end of the prop reaches around the infant's legs and extends along its back to keep the infant lying on its side. In an alternate embodiment, the prop is shortened to approximately the length of an infant and placed on one side of the infant, while a second, unconnected props is used on the infant's other side. The shells of the alternate embodiment are filled to compaction with prills and thereby relatively inflexible.

19 Claims, 3 Drawing Sheets

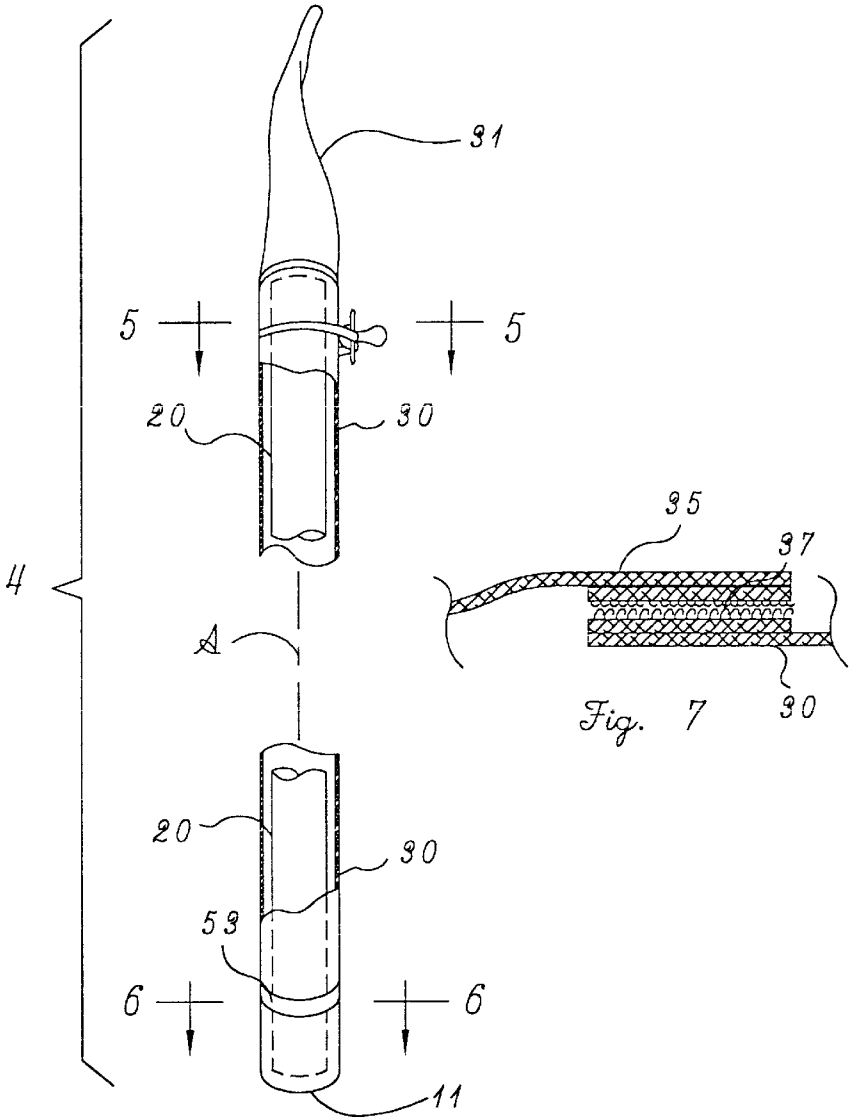
Fig. 4
Fig. 7
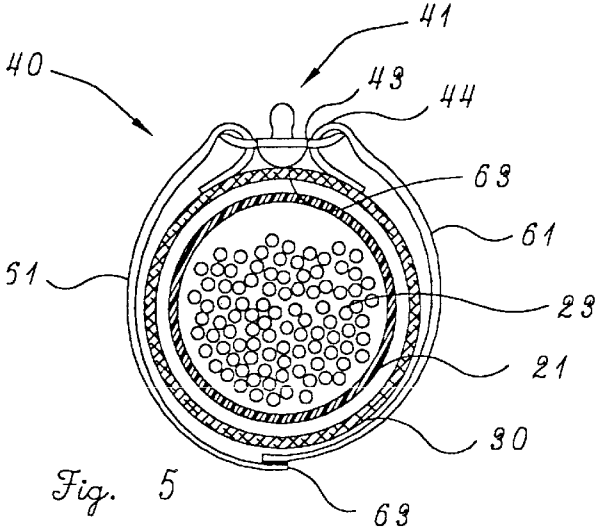
Fig. 5
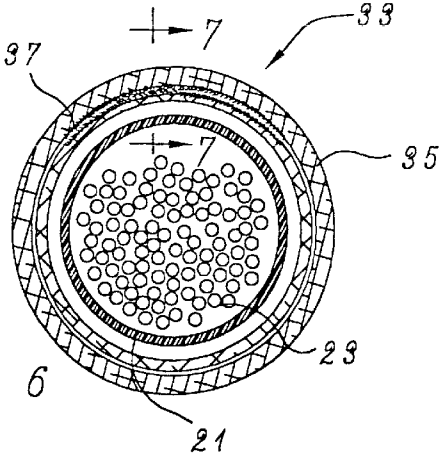
Fig. 6

INFANT PROP

This application claims benefit of Provisional Application Serial No. 60/220,333 filed Jul. 24, 2000.

BACKGROUND OF THE INVENTION

1. Field of the Invention

This invention relates to newborn infant care, and particularly to accessories for cribs and other sleeping accommodations for infants. More particularly, this invention relates to means for securing an infant in a safe, desirable posture while sleeping, and most particularly to a prop for keeping an infant on its side while sleeping.

2. Description of Related Art

Sudden Infant Death Syndrome ("SIDS") and other infant maladies are among reasons infant care personnel and mothers alike prefer that sleeping infants, especially newborns, sleep on their sides. One school of thought holds that SIDS occurs as a form of suffocation arising at least in part because the newborn is too weak to turn itself onto its side. Especially when infants are ill, mucous discharges have been accused of clogging nasal and lung passages. Means for keeping newborns and other infants sleeping on their sides are a way of life for care personnel.

Probably for millennia, infants have been propped on their sides by rolling up cloth or other material into a cylindrical shape and wedging it behind the infant's back. Because terry cloth towels in particular offer the advantages of appropriate size, common availability and softness of texture, they commonly serve the purpose. Towels can become unrolled by infant movements, however, and are not ideal for the purpose. When rolled up, towels also can be less flexible and tend to try to straighten out on their own. An object of fixed, cylindrical cross section and appropriate length and flexibility would serve the purpose of an infant prop much better than towels.

Infants, especially newborns, have a natural instinct to nurse immediately upon waking. Being unable to locate a nipple, whether of its mother or a surrogate such as a pacifier, immediately can lead to psychological stress and correlative crying well known to parents and child care personnel. Means for enabling infants to locate a pacifier would be beneficial.

SUMMARY OF THE INVENTION

Accordingly, it is an object of this invention to provide a prop for sleeping infants.

It is another object of this invention to provide a flexible, fixed form for an infant prop which will not unroll or straighten out during use.

It is another object of this invention to provide an infant prop having a soft, tender texture for direct contact with a baby's skin.

It is yet another object of this invention to provide means for newborns and other relatively helpless sleeping infants to locate a pacifier immediately upon waking.

The foregoing and other objects of this invention are achieved by providing an infant prop composed of a cylindrical core covered with a flannel sheath. The core is approximately two inches in diameter and sufficiently long to form a U-shaped arch reaching around a sleeping infant. It comprises a flexible shell filled with plastic prills or other beads sufficient to maintain its shape but with enough space inside to allow folding and flexibility. The flannel sheath includes an opening for inserting the shell at one end and attachment means for a pacifier disposed facing the infant's mouth, while the other end of the prop reaches around the infant's legs and extends along its back to keep the infant lying on its side. In an alternate embodiment, the prop is shortened to approximately the length of an infant and placed on one side of the infant, while a second, unconnected prop is used on the infant's other side. The shells of the alternate embodiment are filled to compaction with prills and thereby relatively inflexible.

BRIEF DESCRIPTION OF THE DRAWINGS

The novel features believed characteristic of the present invention are set forth in appended claims. The invention itself, however, as well as a preferred mode of use and further objects and advantages thereof, will best be understood by reference to the following detailed description of one or more illustrative embodiments when read in conjunction with the accompanying drawings, wherein:

FIG. 4 is a partial view of one end of the invention showing one type of pacifier attachment means.

FIG. 5 is a cross section through the prop showing another type of pacifier attachment means.

FIG. 6 is a cross section through the prop at the opening in the sheath.

FIG. 7 is a cross section through the sheath opening.

DETAILED DESCRIPTION OF A PREFERRED EMBODIMENT

Figure 1:
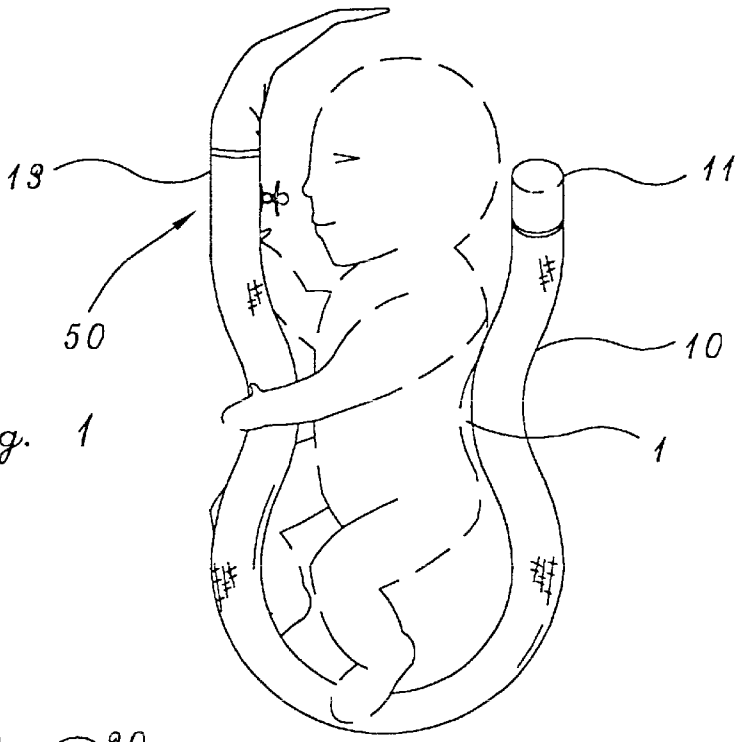
FIG. 1 shows the infant prop of the present invention in use with a sleeping baby.
Figure 2:
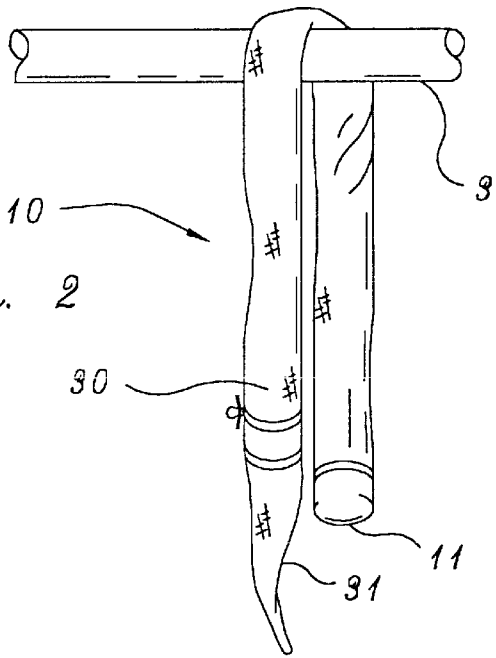
FIG. 2 depicts the invention draped over a hanger.
Figure 3:
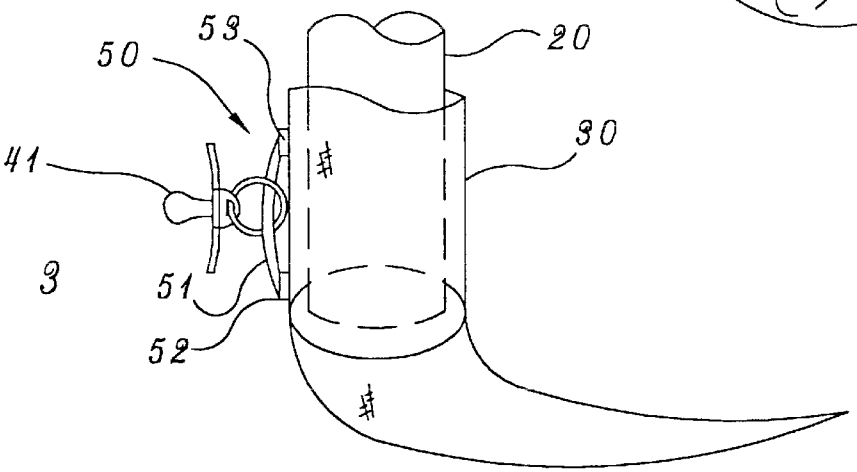
FIG. 3 is a partial view of one end of the invention showing one type of pacifier attachment means.

With reference now to the figures, and in particular to FIGS. 1–5, infant prop 10 is shown (FIG. 1) disposed along infant 1's back such that infant 1 is propped on its side while sleeping. Prop 10 further extends around the end of infant 1 and back up in front of infant 1's face to terminate above its head. Prop 10 is of sufficient length that infant 1 easily may stretch its legs and move conveniently without kicking prop 10 away from its displayed position. For most newborn infants, prop 10 is approximately two (2 in.) inches in diameter and thirty-six (36 in.) inches long. One having ordinary skill in the art will recognize that the specific dimensions of prop 10 are not controlling, but will vary with the age and size of infant 1.

Prop 10 includes core 20 comprising shell 21 partially filled with fill material 23, such as beads, and covered with soft fabric sheath 30. Shell 21 is substantially cylindrical in shape and sealed once filled with beads 23. Preferably, shell 21 is made of vinyl material sufficiently thin that it may be stitched conveniently yet will remain durable, waterproof and relatively puncture resistant. Shell 21 alternately may be made of any waterproof, flexible material such as other plastics or leather (if waterproofed).

Sheath 30 surrounds shell 21 entirely, and includes opening 33 (FIG. 6) through which shell 21 may be removed so that sheath 30 may be laundered. Opening 33 comprises flap 35 overlapping aperture 36 through the side of sheath 30, held closed by closure means 37. Aperture 36 is sufficiently long to extend over the end of core 20. Closure means 37 preferably comprises hook and loop strips known commercially as Velcro, but can be other commonly available closure means such as snaps, buttons or the like. Though it could be located at a variety of places along the length of prop 10, preferably opening 33 is a few inches from end 11 thereof such that core 20 easily may be withdrawn. Further, it preferably is not exactly at end 11 lest movement of core 20 within sheath 30 unduly stress closure 37, yet is close enough to end 11 that closure 37 can stretch over end 11 to remove core 20.

Sheath 30 preferably comprises flame-retardant treated cotton flannel commonly available, and may be printed with non-toxic patterns and decorations. Sheath 30 alternately may be any flexible fabric such as polyester, wool blend, satin, silk or rayon, the salient trait of sheath 30 being that it is soft to the touch of a baby's skin. Sheath 30 may include other accessory decorations 31 as well.

Fill material 23 preferably comprises polypropylene beads, or prills, of approximately three-sixteenths (3/16in.) inch diameter and available under the trade name "Poly-Pellets" from Fairfield Processing Corporation of Danbury, Conn. One having ordinary skill in the art will recognize that many alternate fill materials may serve as beads 23, such as styrofoam, lentil beans, gravel or sand, without departing from the spirit and scope of the present invention.

Prop 10 so configured can maintain its shape but easily may be folded and arranged as shown in FIG. 1. As demonstrated in FIG. 2, prop 10 preferably includes sufficient space inside shell 21 that beads 23 may shift around. This allows prop 10 to be laid over hanger 3, deforming in the middle and dangling like a necktie or other substantially flexible object. Prop 10 is filled sufficiently, however, that when laid flat it maintains its cylindrical shape for propping infant 1. For these criteria, beads 23 occupy between sixty (60%) and eighty (80%), preferably seventy (70%), of the interior volume of shell 21. For the dimensions discussed above, beads 23 comprise approximately twenty four (24 oz.) to thirty-six (36 oz.), preferably thirty (30 oz.), ounces of the preferred polypropylene prills.

Sheath 30 also includes pacifier attachment means near end 11, distal from opening 33. The attachment means comprise two different straps adapted to attach two commonly available types of pacifiers. Vertical attachment means 50 (FIGS. 1 and 3) includes strap 51 stitched at one end 52 to the outer surface of sheath 30 and extending parallel axis A to snap 53. Strap 51 feeds through a loop handle common on many pacifiers 41 and holds pacifier 41 in position relative to infant 1's face. Some pacifiers 41 have no loop handle 42, however, but usually include a plurality of apertures 44 through shield 43. Alternate attachment means 40 (FIGS. 4 and 5) comprises horizontal strap 61 stitched at its midpoint 63 to the outer surface of sheath 30 and extending through apertures 44 on opposite sides of shield 43. The distal ends, or tails, of strap 61 are of sufficient length to reach around prop 10 and to snap together on its opposite side, away from pacifier 41 and infant 1's face. One having ordinary skill in the art will recognize that prop 10 maybe equipped with either or both attachment means 40, 50 without departing from the spirit and scope of the present invention.

In operation, inner core 20 of prop 10 is inserted into sheath 30 through opening 33 which is secured using closure 37. If desired, pacifier 41 is attached at attachment means 40 or 50 as discussed above. Infant 1 is laid on its side in a crib or other sleeping arrangement and prop 10 is laid behind its back as shown in FIG. 1 such that infant 1 rests its weight at least partially against prop 10. Preferably, end 11 of prop 10 bearing opening 33 is behind infant 1's head, but need not extend substantially above infant 1's head. Opposite end 13 of prop 10 then is wrapped around the end of infant 1's feet such that infant 1 has plenty of room to stretch and kick without moving prop 10. End 13 then is brought into proximity with infant 1's face such that pacifier 41 is directly in front of infant 1's mouth. Thereby, infant 1 may locate pacifier 41 by its natural nuzzling and nursing instincts, thus minimizing or avoiding waking anxiety, and the correlative crying, so common to babies.

Figure 9:
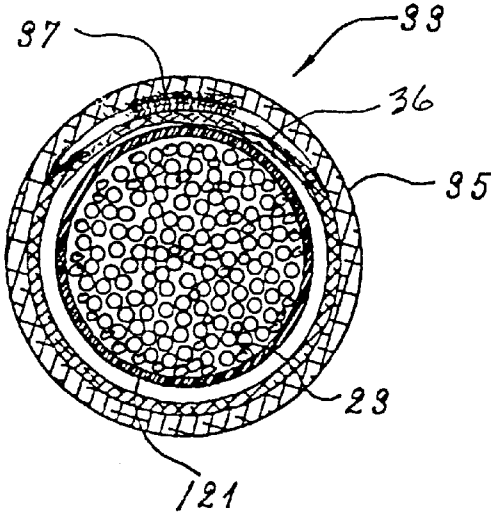
FIG. 9 is a cross section through the alternate embodiment prop as indicated in FIG. 8.
Figure 8:
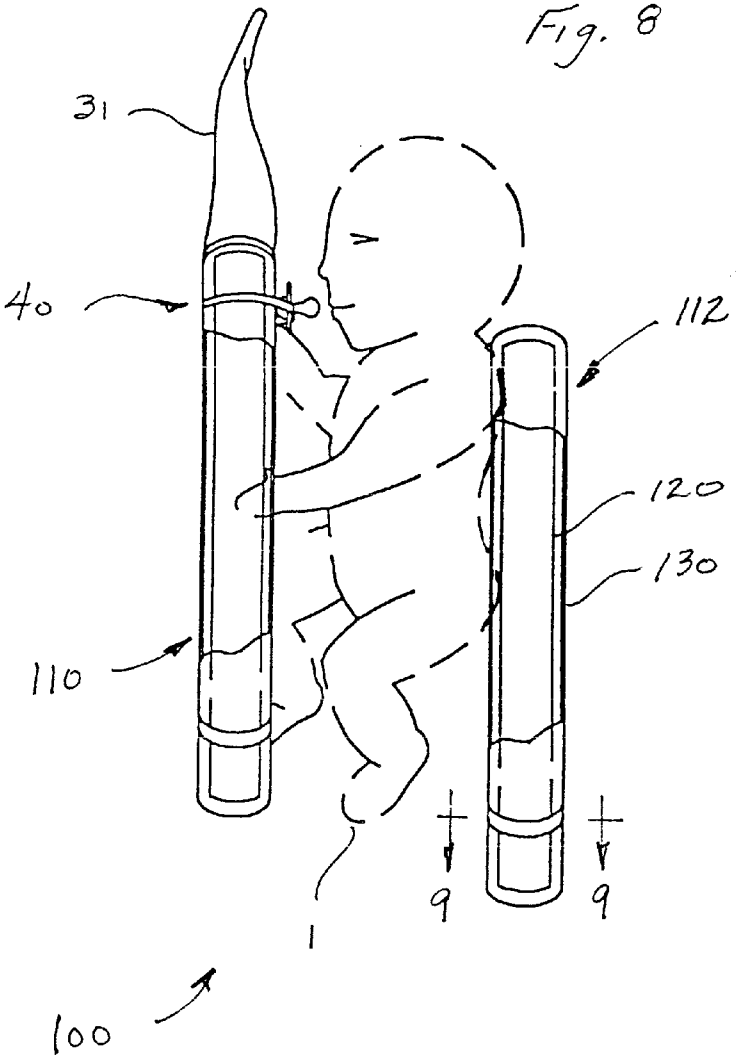
FIG. 8 shows an alternate embodiment of the infant prop of the present invention in use with a sleeping baby.

In an alternate embodiment 100 in FIGS. 8 and 9, prop 110 is shortened to approximately half the length of prop 10 of the preferred embodiment and supplemented by second prop 112. Prop 110 is shorter than prop 10 but otherwise includes all its features, except as discussed below. Prop 112 may be simpler, omitting the pacifier attachment means and decoration 31 for sheath 130, but including the same core 120 and closure means 37. For props 110, 112, however, cores 120 are filled completely, to substantially their interior volume, with prills 23 (FIG. 9), rather than being partially filled (FIG. 6) as with core 20. Such filling makes cores 120 relatively stiff and inflexible, necessitating the use of two props 110, 112 as shown in FIG. 8 to secure properly infant 1 on its side. Alternate embodiment 100 is preferred where, because core 20 is only partially filled and flexible, there may be a concern that infant 1 could smother itself by forcing depressions or folds that cover its nose and mouth.

Props 10 and 110, 112 thus provide a much improved means and method of securing a baby on its side while sleeping. Props 10 and 110, 112 may be provided in various lengths to accommodate babies of various ages and sizes. They may be used by hospital personnel for newborn and premature babies, as well as mothers once they get their newborns home. Likewise, props 10 and 110, 112 may serve for weeks or months as a crib accessory for older babies. Props 10 and 110, 112 comprise simple, inexpensive materials which render their cost sufficiently low that they may be provided to mothers of newborns by their hospitals, as well as readily available in maternity and baby stores. They may come with replacement sheaths 30, 130 so that cores 20, 120 may continue in use while several sheaths 30, 130 are laundered. Finally, pacifier attachments 40, 50 render pacifier 41 easy for newborns to find, granting a boon to nursery personnel who thereby may be spared a few steps when infant 1 wakes and seeks to nurse.

While the invention has been particularly shown and described with reference to a preferred embodiment, it will be understood by those skilled in the art that various changes in form and detail may be made therein without departing from the spirit and scope of the invention. For example, it would be possible to connect props 110, 112 with a tether of fabric or cord (not shown) to make them a single unit. Though within the scope of the present invention, this would be undesirable in many situations because of the possibility of infant 1 getting the tether wrapped around its neck.

We claim:

1. An infant prop having a longitudinal length and axis and comprising a first cylindrical core having an interior containing fill material;

a first fabric sheath surrounding the first core and having an opening near a proximate end through which the first core may be inserted and removed;

closure means for securing the opening; and decoration means on an outer surface of the first sheath; and pacifier attachment means disposed on the first sheath at a distal end opposite the opening and having a strap stitched to the first sheath at its midpoint and having a first tail distal from the midpoint and extending circumferentially around the prop to engage a first aperture in a pacifier; and a second tail opposite the first tail and extending opposite thereof around the prop to engage a second aperture in the pacifier;

whereby the first and second tails further extend circumferentially away from the pacifier to couple together near the midpoint and to secure the pacifier to the first sheath.

2. The infant prop according to claim 1 wherein the prop is sufficiently long and flexible that the proximate end may be disposed in front of the infant's face while the distal end is disposed adjacent the infant's back, whereby the prop surrounds the infant.

3. The infant prop according to claim 1 wherein the longitudinal length of the prop is at least twice the length of a sleeping infant.

4. The infant prop according to claim 1 wherein the first core is flexible enough that the prop may be folded in half.

5. The infant prop according to claim 4 wherein the fill material occupies between sixty and eighty percent of the interior volume of the core.

6. The infant prop according to claim 5 wherein the fill material occupies seventy percent of the interior volume of the core.

7. The infant prop according to claim 1 wherein the fill material occupies between sixty and eighty percent of the interior volume of the core.

8. The infant prop according to claim 1 wherein the fill material occupies seventy percent of the interior volume of the core.

9. The infant prop according to claim 1 wherein the fill material comprises polypropylene beads.

10. The infant prop according to claim 1 wherein the closure means comprises hook and loop strips disposed on opposite sides of the opening.

11. The infant prop according to claim 1 and further comprising a second cylindrical core having an interior containing fill material;

a second fabric sheath fitted to and adapted to surround the second core and having an opening near its proximate end through which the second core may be inserted and removed; and closure means for securing the opening.

12. The infant prop according to claim 11 wherein the first and second cores are substantially the same length.

13. The infant prop according to claim 11 wherein the first and second cores are substantially the length of an infant.

14. The infant prop according to claim 11 wherein the first and second cores are filled to substantially one hundred percent of their interior volumes with fill material.

15. An infant prop comprising first and second cylindrical cores, each core having an axis and an interior containing fill material;

a fabric sheath surrounding the core and having a core access opening near one end; and closure means for securing the opening;

decoration means on an outer surface of at least one of the sheaths; and pacifier attachment means disposed on one of the sheaths axially opposite the opening and adapted to hold a pacifier affixed along the axis close to the sheath.

16. The infant prop according to claim 15 wherein the first and second cores are filled to substantially one hundred percent of their interior volumes with fill material.

17. The infant prop according to claim 15 wherein the pacifier attachment means comprises a strap having a strap length and disposed on the sheath parallel the axis, the strap having a first end stitched to the sheath at a first location along the axis; and a second end removably attached to the sheath at a second location along the axis.

18. The infant prop according to claim 17 wherein the second location is disposed along the axis a distance from the first location substantially equivalent to the strap length, whereby the strap holds the pacifier rotatably against the sheath when the strap is attached by the second end.

19. An improved method of securing an infant in a sleeping position in its bed, the method comprising providing an infant prop having an axis extending between first and second ends at least one cylindrical core having an interior containing fill material;

a fabric sheath surrounding the core and having a core access opening near the first end; and closure means for securing the opening;

decoration means on an outer surface of the sheath; and a pacifier attachment disposed on the sheath near the second end and having a strap stitched to the sheath at its midpoint and having a first tail distal from the midpoint and extending circumferentially around the prop to engage a first aperture in a pacifier; and a second tail opposite the first tail and extending opposite thereof around the prop to engage a second aperture in the pacifier;

whereby the first and second tails further extend circumferentially away from the pacifier to couple together near the midpoint and to secure the pacifier to the sheath;

placing the infant on its side in the bed; then placing the first end behind the infant's back near its head; then curling the prop around the infant's feet to extend upward in front of the infant's face whereby the second end is disposed near the infant's head with the pacifier means toward the infant's face.

* * * * *